US010316587B2

(12) United States Patent
Bachand et al.

(10) Patent No.: US 10,316,587 B2
(45) Date of Patent: Jun. 11, 2019

(54) PIPE RAMMING SYSTEM WITH HYDRAULIC CROWD

(71) Applicant: TCG TUNNELING COMPANY INC., Kamloops (CA)

(72) Inventors: Malcolm Bachand, Kamloops (CA); Shawn Gaunt, Kamloops (CA); Richard Bachand, Kamloops (CA)

(73) Assignee: TCG TUNNELING COMPANY INC., Kamloops (CA)

( * ) Notice: Subject to any disclaimer, the term of this patent is extended or adjusted under 35 U.S.C. 154(b) by 613 days.

(21) Appl. No.: 14/935,315

(22) Filed: Nov. 6, 2015

(65) Prior Publication Data

US 2016/0333642 A1 Nov. 17, 2016

(30) Foreign Application Priority Data

May 15, 2015 (CA) ..... 2891805

(51) Int. Cl.
*E21B 7/20* (2006.01)

(52) U.S. Cl.
CPC ..... *E21B 7/205* (2013.01)

(58) Field of Classification Search
CPC . E21B 7/20; E21B 7/201; E21B 7/203; E21B 7/205; E21B 7/206; E21B 7/26; E21B 7/30
USPC ..... 173/112–113; 177/8, 9, 189, 193, 106, 177/107, 218
See application file for complete search history.

(56) References Cited

U.S. PATENT DOCUMENTS

| | | | | |
|---|---|---|---|---|
| 5,749,677 | A * | 5/1998 | Grigoraschenko | E21B 4/145 173/90 |
| 6,357,967 | B1 * | 3/2002 | Putnam | F16L 55/1658 254/29 R |
| 6,652,190 | B1 | 11/2003 | Verkyk | |
| 7,624,817 | B2 * | 12/2009 | Putnam | E21B 7/30 175/53 |
| 8,328,468 | B2 * | 12/2012 | Tjader | B23D 21/02 405/156 |
| 8,540,458 | B2 * | 9/2013 | Herrick | F16L 55/1658 405/184.1 |
| 8,702,349 | B2 * | 4/2014 | Carter | F16L 55/1658 405/184.1 |
| 9,103,483 | B2 * | 8/2015 | Tjader | F16L 55/1658 |
| 2016/0333642 | A1 * | 11/2016 | Bachand | E21B 7/205 |

FOREIGN PATENT DOCUMENTS

CA 2504950 A1 5/2004

* cited by examiner

*Primary Examiner* — Jason Daniel Prone
*Assistant Examiner* — Richard D Crosby, Jr.
(74) *Attorney, Agent, or Firm* — Michael A. Glenn; Perkins Coie LP

(57) ABSTRACT

A horizontal pipe ramming system includes a hydraulic crowd system. A hydraulic percussive hammer is mounted on a carriage that is urged forward by hydraulic cylinders acting between the carriage and an abutment. The continuity of crowd is enhanced by a compressive resilient assembly that releases its energy to the hammer to keep it in contact with the pipe after impact.

1 Claim, 10 Drawing Sheets

PIPE RAMMING SYSTEM WITH HYDRAULIC CROWD

FIELD OF THE INVENTION

This invention relates to pipe ramming. In particular, this invention relates to a system for accommodating a hydraulic percussive hammer and applying crowd to it in a pipe ramming system.

BACKGROUND OF THE INVENTION

In one conventional approach to pipe ramming, a percussive pneumatic hammer is used to drive the pipe horizontally or at an angle into the ground. The hammer housing is attached to the end of the pipe by means of a suitable fitting and is sometimes further secured by cables. A piston-actuated ram strikes a plate inside the housing and the percussive force is transmitted to the end of the pipe through the housing, thereby causing the pipe to advance into the ground. Friction between the soil and the pipe prevents backward displacement of the pipe while the piston retracts for the next strike. A typical small pneumatic hammer offers 0.17 kJ of energy and delivers 580 blows per minute, weighing less than 10 kg. A typical large hammer has 40 kJ of energy, weighs 12 metric tons and delivers 180 blows per minute.

Hydraulic (rather than pneumatic) hammers are often used in vertical drilling. Hydraulic hammers generally operate at fewer strokes per minute but delivering much more per blow. One hydraulic hammer weighs 4 metric tons, delivers 65 blows per minute at 30 kJ, while a 242 metric ton hammer delivers 2300 kJ at 30 blows per minute. In many hydraulic hammers, the energy per stroke and the strike rate are adjustable. The strike piston extends outside the hammer housing to strike the casing. In vertical drilling, the hammer housing is maintained in contact against the casing principally by means of gravity, though a winch crowd system may also be used for enhanced crowd.

It is also known to use hydraulic percussive hammers disposed horizontally for pipe ramming. Hydraulic hammers provide greater force and the ability to adjust the impact force of a hydraulic hammer allows for tailoring of the system to the soil conditions. However because the ram extends outside the hammer housing, it is not practical to secure the housing to the pipe. It therefore becomes essential to provide crowd of the hammer against the pipe. One approach to doing so is disclosed by Verkyk, U.S. Pat. No. 6,652,190, who relies on a cable winch crowd system (illustrated in FIG. 1A of Verkyk and reproduced as FIG. 1 herein). While the system is reasonably effective in operation, it is unwieldy to set up, taking about a week to do so. The highly tensioned cables also present a significant danger to personnel.

It is an object of the present invention to provide a horizontal pipe ramming system with hydraulic crowd.

It is a further object of the invention to provide a horizontal pipe ramming system that uses a hydraulic hammer and that has an improved crowd system.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

The pipe ramming system of the invention comprises providing a hydraulic crowd to a percussive hammer aligned against the pipe (or against a strike plate, anvil or pipe adaptor interposed between the hammer and the pipe). The hydraulic crowd may be provided by means of one or more hydraulic cylinders.

In the preferred embodiment, the hydraulic cylinders act on a rail-mounted carriage that carries the percussive hammer.

The system allows the hammer harness to remain in close contact with the pipe for more effective delivery of the strike force.

In another aspect, the invention comprises a pipe ramming system that uses a hydraulic hammer aligned with a substantially horizontal pipe.

In a more specific aspect, the hammer comprises a housing carried by a rail-mounted carriage and hydraulic cylinders urge the carriage along the rails toward the pipe.

In yet a more specific aspect, the hydraulic cylinders are mounted on the carriage and act against an abutment that is stationary in relation to the rails. The abutment may comprise a stationary push block.

In another aspect the invention is a pipe ramming system that includes a horizontally disposed hydraulic hammer, hydraulic cylinders to urge a carriage carrying the hammer toward the pipe, and a compressible resilient assembly interposed between the carriage and the hammer. The assembly is compressed by the combined action of the hydraulic cylinders urging the carriage and a hammer harness toward the pipe and of the hammer and associated strike assembly that are braced against the pipe by the crowd force. The resilient assembly decompresses upon the displacement of the pipe resulting from an impact of the hammer.

In another aspect of the invention, the assembly is bounded on the pipe side of the assembly by an assembly abutment surface that is fixed in relation to a housing of the hammer and the assembly is bounded on a side that is distal from the pipe by an assembly abutment surface that moves toward the pipe as the hydraulic cylinders displace the carriage toward the pipe.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF THE PREFERRED EMBODIMENTS AND OF AT LEAST ONE MODE FOR CARRYING OUT THE INVENTION IN TERMS OF EXAMPLE(S)

The preferred embodiment of the invention uses substantially the same rail 12 and carriage 16 set up as does a standard boring machine.

Figure 1:
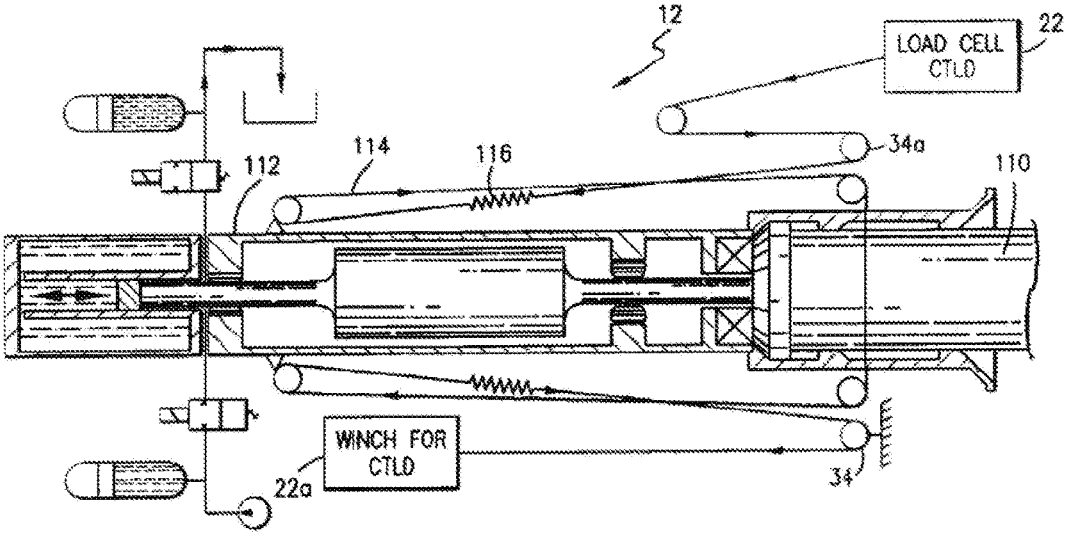
FIG. 1 (Prior Art)
FIG. 1 is a prior art set up for pipe ramming using a hydraulic hammer and a cable winch crowd system.
Figure 2:
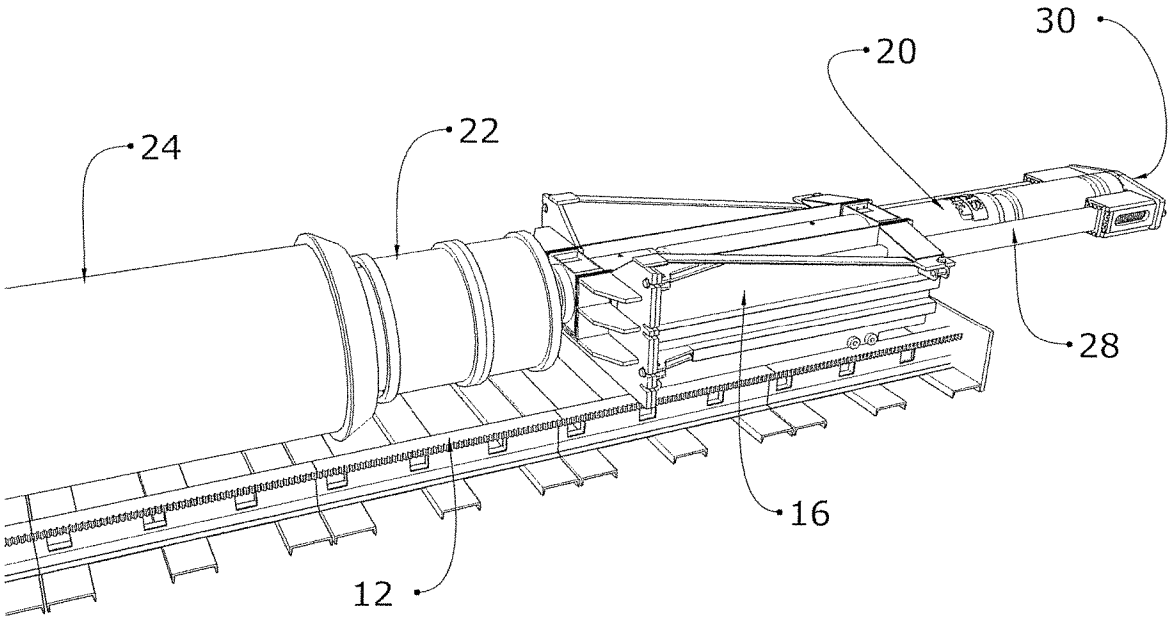
FIG. 2 is a perspective view of a pipe ramming installation according to the preferred embodiment of the invention.
Figure 3:
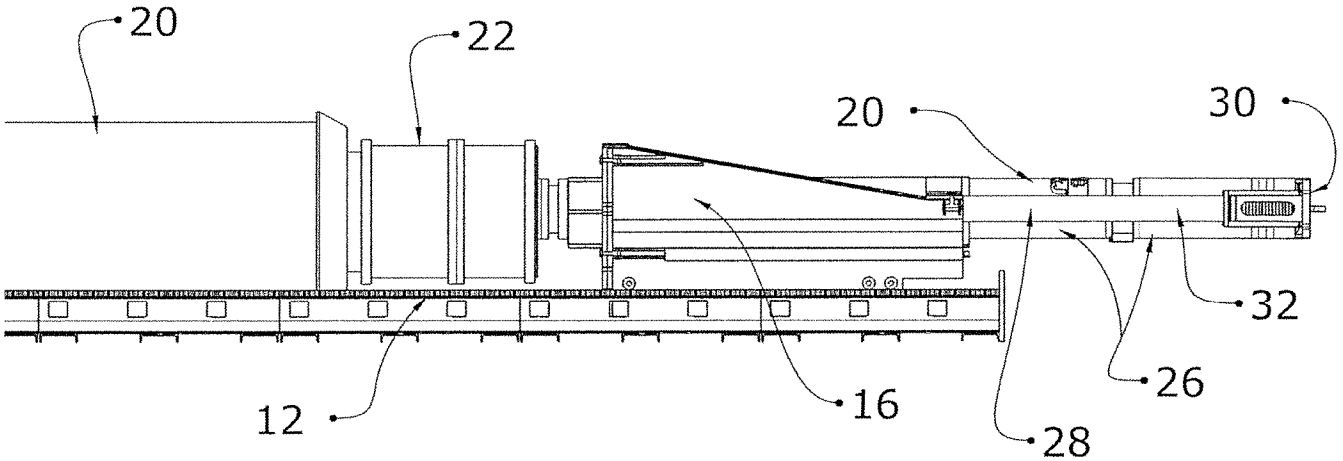
FIG. 3 is a side elevation of the installation of FIG. 2.
Figure 4:
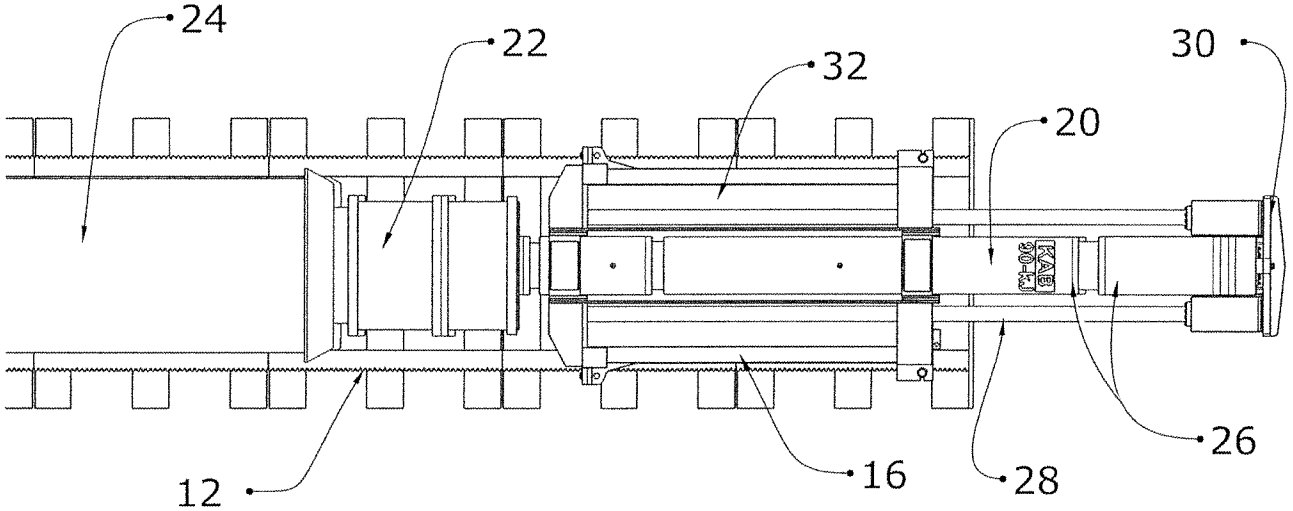
FIG. 4 is a plan view of the installation of FIG. 2.

Referring to FIGS. 2-4, a hydraulic hammer 20 is disposed axially and aligned with a substantially horizontal pipe 24. Hammer 20 includes hammer housing 26 to the end of which is rigidly attached a pipe adaptor 22. A strike plate (not shown) is secured within the pipe adaptor 22. Pipe adaptor 22 serves to maintain the hammer and the strike plate in alignment with the pipe 24. As it is fixed to the hammer housing 26, the pipe adaptor 22 moves along with the hammer housing 26.

During an impact cycle, the forward end of the hammer 20, namely the strike plate and the pipe adaptor 22 should be in contact with the pipe 24 such that when the hammer 20 strikes the strike plate, the percussive force is transmitted to the pipe 24.

In the preferred embodiment, the hammer 20 is an IHC S90 Hydrohammer hydraulic hammer available from IHC Hydrohammer B.V. It offers an adjustable energy of 9 to 90 kJ per stroke.

Hammer housing 26 is cradled by a harness 28 that is secured to the carriage 16.

Figure 6:
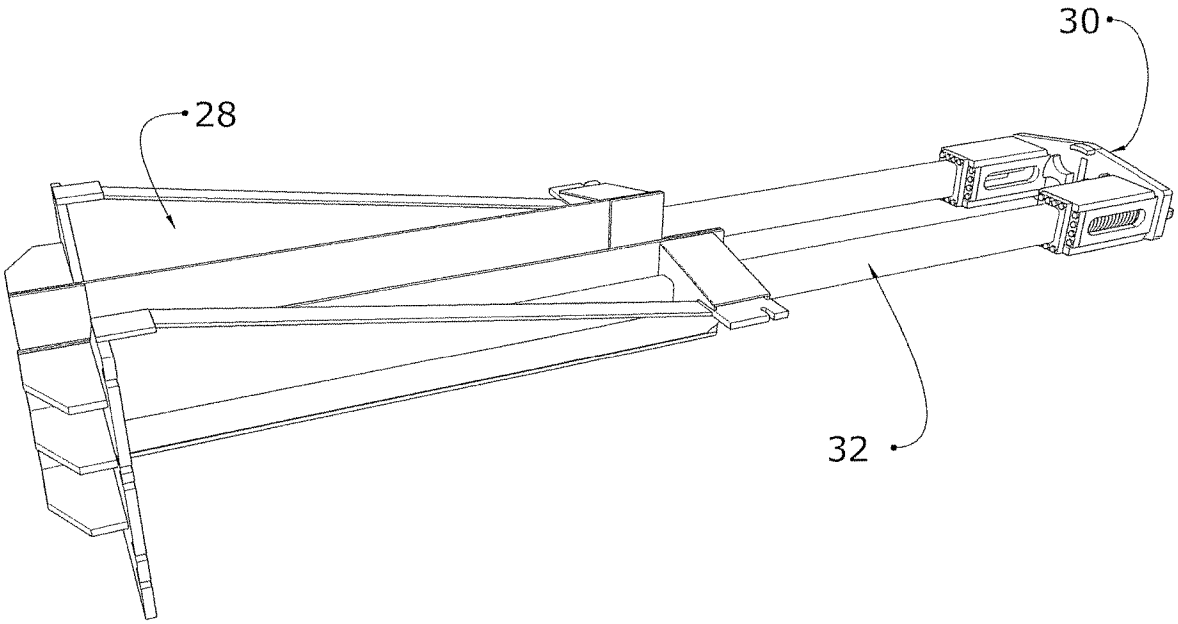
FIG. 6 is a perspective view of a harness for holding a hydraulic hammer according to the preferred embodiment.
Figure 7:
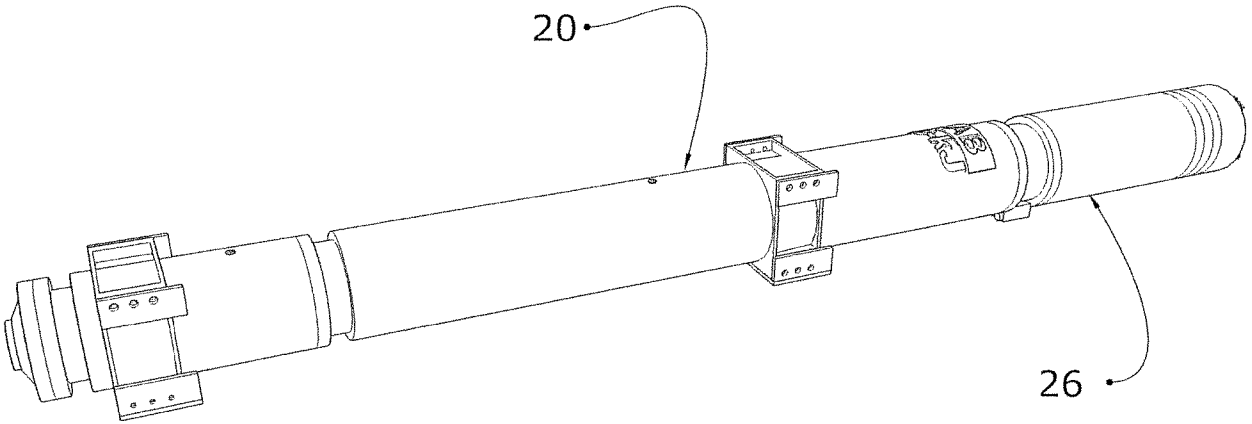
FIG. 7 is a hydraulic hammer used in the preferred embodiment.

The hammer harness 28 comprises a rear portion 30 (FIG. 6) affixed to the hammer housing 26 (FIG. 7) and that is translatable in relation to a forward portion 32 of the hammer harness that is fixed to the carriage 16. Relative movement between them compresses a rubber cushion assembly 34 located at the rear of the harness 28. The cushion assembly 34 is interposed between the carriage 16 and the hammer.

An adjustable push block 35 is secured by dogs 38 inserted into apertures 40 (see. FIG. 5A) in the rails 12 to provide an abutment for hydraulic cylinders. Hydraulic cylinders 36 mounted in the carriage push against the push block 35 to urge the carriage 16 along the rails toward the pipe 24 at a steady pressure and pace to cause the carriage 16 to advance. The supply of such hydraulic crowd to the hammer 20 is one aspect of the present invention.

Figure 5:
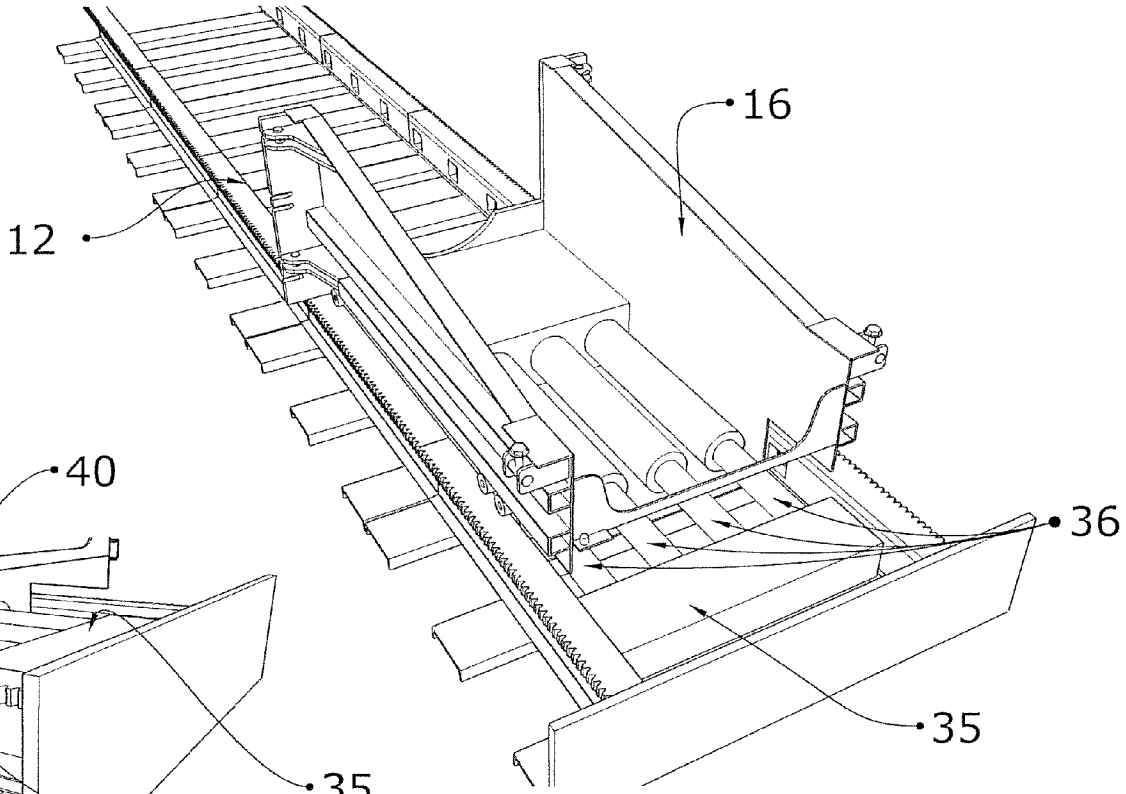
FIG. 5 is a perspective view of a rail and carriage set up used in the preferred embodiment and showing hydraulic cylinders used to provide crowd.
Figure 5A:
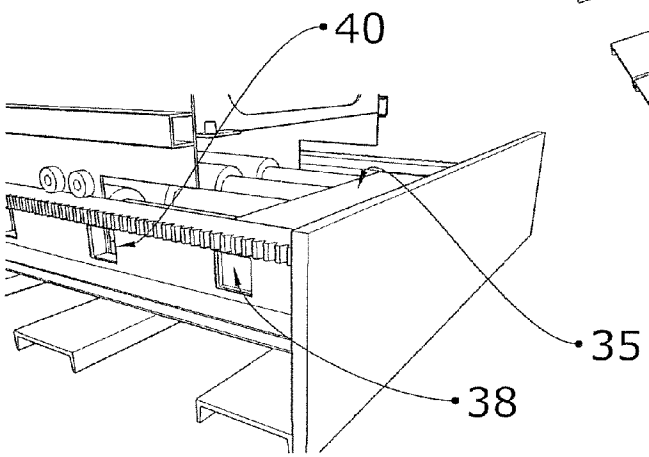
FIG. 5A is a perspective side view of a rail and carriage set up used in the preferred embodiment showing apertures in the rails.

Referring to FIG. 5, as the carriage 16 is urged forward by the action of the hydraulic cylinders 36 against the push block 35, the reaction force of the hammer assembly abutting against the pipe 24 causes the hammer housing 26 and the rear portion 30 of the harness 28 to which it is attached to be held in place against forward movement while the carriage 16 and the forward portion 32 of the harness 28 that is attached to it are urged forward. This causes relative translation between the rear portion 30 and the forward portion 32 of the harness 28 that in turn causes the cushions 42 in the cushion assembly 34 to be compressed. Without the cushion assembly 34, once the hammer hits the strike plate and transmits the percussive force to the pipe 24 and thereby moves the pipe 24 forward, a gap would be introduced between the hammer 20 and the pipe 24. The hydraulic crowd offered by the cylinders 36 would eventually cause the hammer 20 to catch up to the displaced pipe 24. A further impact of the hammer would then need to wait for the carriage 16, the harness 28 and the hammer 20 to be brought back into contact with the pipe 24. However, the presence of the cushion assembly 34 provides a nearly instantaneous release of the tension in the cushions 42 to urge the hammer 20 forward in relation to the carriage 16 and to thereby closely track the forward movement of the pipe 24 and to maintain the hammer assembly in contact with the pipe.

The cushion assembly 34 thereby allows the hammer 20 to almost instantaneously track the displacement of the pipe 24 and helps to maintain crowd even though the hydraulic crowding of the carriage 16 toward the pipe 24 may be delayed as it catches up to the displaced pipe. The built up pressure in the cushions 42 effectively accelerates the repositioning of the hammer forward against the pipe 24 while the carriage 16 catches up.

Once the carriage 16 has been advanced beyond the extension capacity of the cylinders 36 (typically after several impact cycles of the hammer), the system is reset by removing the push block 35 from its last position and advancing it to a new position on the rail 12, and securing the dogs 38 in new apertures 40. The operation of the hydraulic crowd from cylinders 36 and the reciprocating percussion of the hammer 20 may then be resumed.

Figure 8:
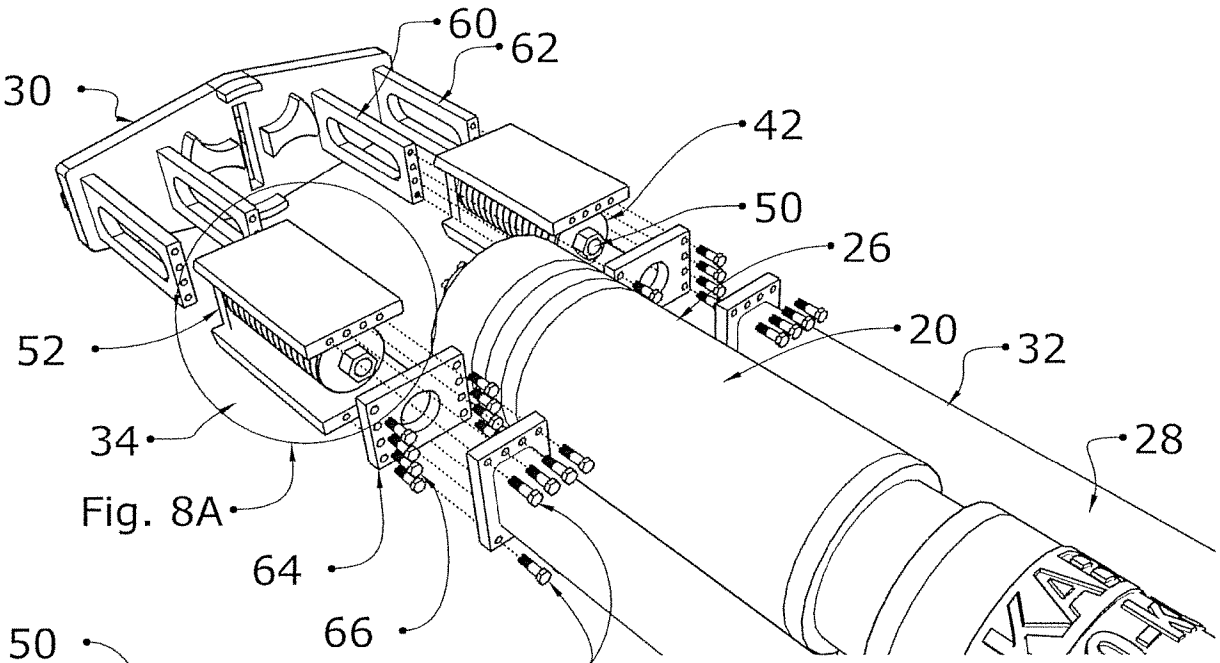
FIG. 8 is an exploded perspective view of the cushion assembly of the preferred embodiment and also showing a hammer and portions of the hammer harness.
Figure 8A:
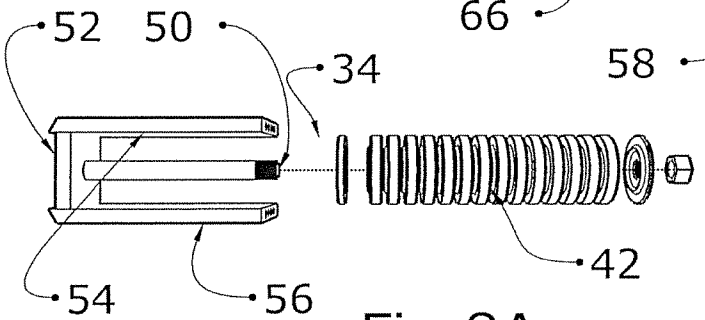
FIG. 8A is an exploded side view of the cushion assembly.

Referring to FIGS. 8 and 8A, the cushion assembly 34 comprises a centering rod 50 mounted in cantilever fashion from a back plate 52 extending between opposed forward mounting plates 54, 56. A plurality of rubber ring cushions 42 are installed about the rod 50. The forward mounting plates 54, 56 are secured by bolts 58 to the forward portion 32 of the harness (more particularly to an attachment flange 59). As a result, when the carriage 26 and its dependent forward portion 32 of the harness are urged forward by the hydraulic cylinders 36 toward the pipe 24, the forward mounting plates 54, 56 and the back plate 52 are also urged forward.

The rear portion 30 of the harness includes forwardly extending connectors 60, 62 which are attached to an abutment plate 64 by means of bolts 66. The abutment plate 64 is dimensioned so as to be displaceable between and inward of the forward mounting plates 54, 56. Such relative displacement and sandwiching between the abutment plate 64 on the one hand, and the forward mounting plates 54, 56 and the back plate 52 on the other hand, results in a compression or a relaxation of the cushions 42 of the assembly.

In the preferred embodiment, the system includes two opposed cushion assemblies, one on each side of the hammer 20.

As a result of the arrangement described above, the cushion assembly is bounded on the pipe side of the assembly by an assembly abutment surface that is fixed in relation to a housing of the hammer and the assembly is bounded on a side that is distal from the pipe by an assembly abutment surface that moves toward the pipe as the hydraulic cylinders displace the carriage toward the pipe.

Figure 9:
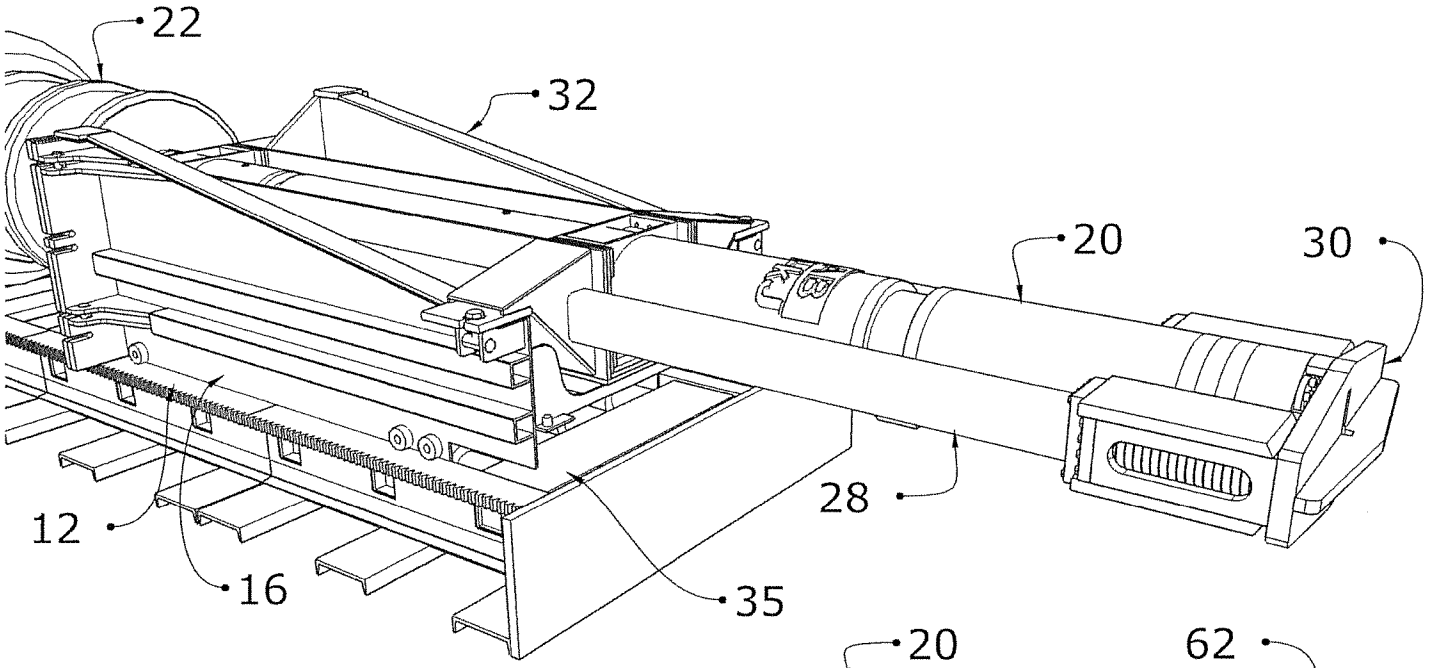
FIG. 9 is a perspective view of the system of the invention showing the hammer housing in a forward position at the moment of hammer strike.
Figure 9A:
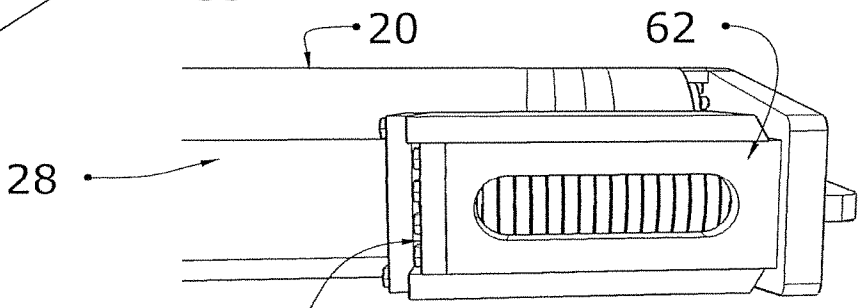
FIG. 9A is an enlarged view of the cushion assembly in the position shown in FIG. 9.
Figure 10:
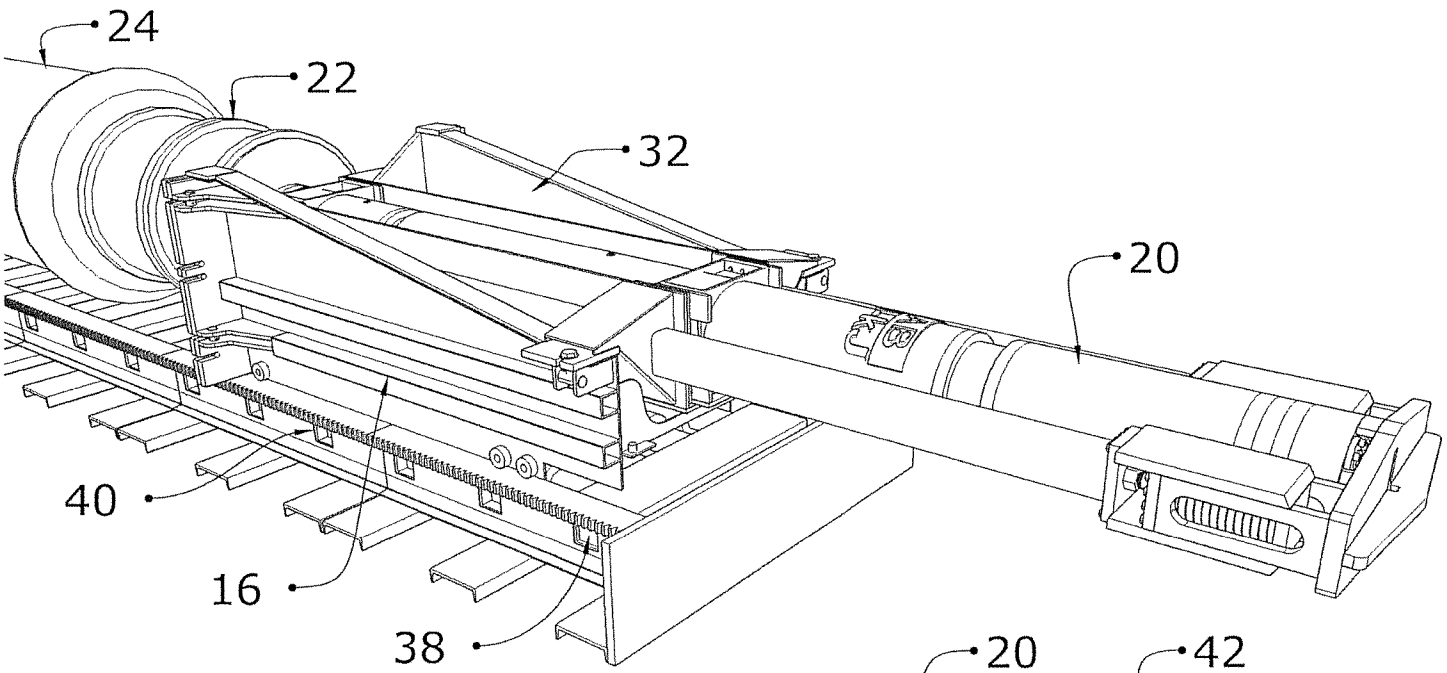
FIG. 10 is a perspective view of the system of the invention showing the hammer housing in a cocked position immediately prior to a hammer strike; and, FIG. 10A is an enlarged view of the cushion assembly in the position shown in FIG. 10.
Figure 10A:
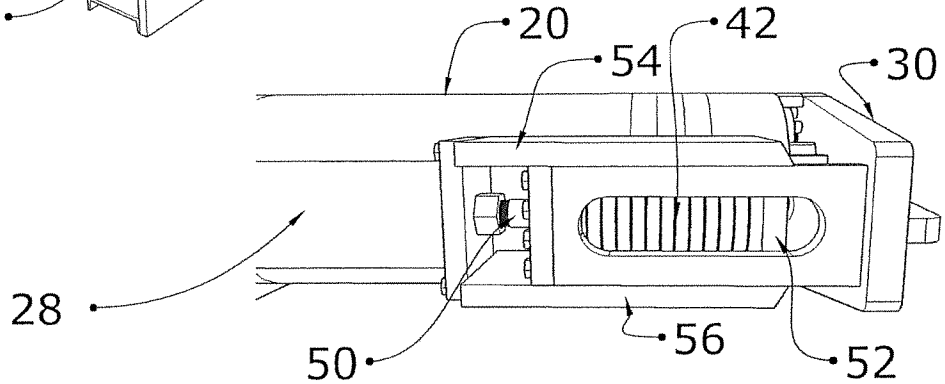

FIGS. 9 and 9A show the positions of the components of the cushion assembly 34 with the hammer housing 26 in its extended position, the hammer 20 having just delivered a blow to the strike plate. The cushions 42 are relaxed and fully extended so that the forward 32 and rear 30 portions of the harness 28 are both in an advanced position in relation to the pipe 24. The hammer 20 is in contact with the pipe 24 and the carriage 16 remains some distance from the pipe 24. The crowd of the hydraulic cylinders 36 urges the carriage 16 and the forward portion 32 of the harness 28 toward the pipe 24 (against which the hammer 20 is already braced). As shown in FIGS. 10 and 10A, the pressure is taken up by the cushions 42 which compress, allowing the carriage to progress toward the pipe 24 and causing the forward portion 32 of the harness to also advance in relation to the relatively stationary rear portion 32 of the harness.

Once the hammer 20 is triggered to strike the strike plate, the hammer within the hammer housing 26 is propelled forward of the housing 26 and strikes the strike plate, jolting the pipe 24 forward. The displacement increases the distance between the pipe 24 and the carriage 16 but the steady crowd pressure applied by the hydraulic cylinders 36 is not sufficient to cause the carriage 16 to instantaneously reposition the hammer assembly against the pipe. The cushions 42 react more quickly, releasing their energy to drive the rear portion 32 of the harness and the hammer 20 forward into contact with the pipe.

By the system of the preferred embodiment, the inventors have achieved an approximate nearly constant minimum crowd of the hammer on the pipe of 40 tonnes during the impact cycle of the hammer.

The invention therefore provides a hydraulic crowd for a reciprocating percussive hammer in a horizontal pipe ramming system.

The effectiveness of the hydraulic crowd is further enhanced by the use of a compressive resilient assembly (the cushion assembly in the preferred embodiment) that is effectively interposed between the hammer and the carriage against which hydraulic crowd is applied.

It will be appreciated that the resilient assembly need not necessarily be rubber cushions. Other compressive resilient devices may be as effective, such as metal springs, or very high pressure pneumatic systems.

Other structural alterations to the preferred embodiment may also be made without departing from the inventive aspects.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A horizontal pipe ramming system, comprising:

rails;

a carriage mounted on said rails:

a harness carried on said carriage, said harness cradling a percussive hammer for striking a pipe in horizontal alignment with said hammer;

said carriage being urged forward on said rails by hydraulic cylinders acting between the carriage and an abutment that is stationary in relation to said rails;

said harness comprising:

a first part of said harness that is fixed in relation to said carriage;

a second part of said harness that is displaceable in relation to said first part;

a resilient compressible assembly being interposed between said first and second parts;

said hydraulic cylinders acting to displace said first part in relation to said second part and toward said pipe, thereby compressing said compressible assembly against said second part; and, said second part carrying said hammer;

said compressible assembly urging said second part and said hammer toward said pipe after said pipe is displaced by an impact of the hammer on said pipe.

* * * * *